US007665801B2

(12) United States Patent
Lee

(10) Patent No.: US 7,665,801 B2
(45) Date of Patent: Feb. 23, 2010

(54) STRUCTURE OF UPPER FRAME FOR SUPPORTING CABIN OF CONSTRUCTION MACHINERY

(75) Inventor: Jin Woo Lee, Kimhae (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 325 days.

(21) Appl. No.: 11/481,286

(22) Filed: Jul. 5, 2006

(65) Prior Publication Data

US 2007/0018484 A1 Jan. 25, 2007

(30) Foreign Application Priority Data

Jul. 25, 2005 (KR) ..... 10-2005-0067283

(51) Int. Cl.
*B62D 33/06* (2006.01)

(52) U.S. Cl. ..... 296/193.03; 296/187.03; 296/187.08

(58) Field of Classification Search ..... 296/187.03, 296/187.08, 190.01, 190.03, 190.08, 35.2; 180/89.12
See application file for complete search history.

(56) References Cited

U.S. PATENT DOCUMENTS 5,984,036 A * 11/1999 Higuchi et al. ..... 180/89.12
2002/0149232 A1* 10/2002 Sakyo et al. ..... 296/190.08
2002/0153748 A1* 10/2002 Sakyo et al. ..... 296/190.08
2004/0245806 A1* 12/2004 Mori et al. ..... 296/187.03
2006/0125287 A1* 6/2006 Fornell et al. ..... 296/190.03
2006/0158006 A1* 7/2006 Mori ..... 296/190.03
2006/0226680 A1* 10/2006 Matsumoto et al. .... 296/190.01
2006/0249986 A1* 11/2006 Yoon ..... 296/190.03
2007/0035160 A1* 2/2007 Murakami ..... 296/190.03
2007/0085379 A1* 4/2007 Murakami ..... 296/190.03

FOREIGN PATENT DOCUMENTS

JP 406042012 A * 2/1994 ..... 180/89.12
JP 2003-082705 A * 3/2003
JP 2004-108039 A * 4/2004

OTHER PUBLICATIONS

Machine translation of JP2003-82705 printed from the JPO website May 6, 2009.*

* cited by examiner

*Primary Examiner*—Jason S Morrow
(74) *Attorney, Agent, or Firm*—Ladas & Parry LLP

(57) ABSTRACT

A structure of an upper frame for supporting a cabin of construction machinery, whereby, in the event of a rollover accident, an excessive vertical load or rearward load applied to a cabin structure is primarily dispersed by a reinforcing member of the cabin structure, and the dispersed load is supported by a separate cabin supporting structure, so that the plastic deformation of the cabin structure can be minimized.

12 Claims, 9 Drawing Sheets

STRUCTURE OF UPPER FRAME FOR SUPPORTING CABIN OF CONSTRUCTION MACHINERY

CROSS-REFERENCE TO RELATED APPLICATION

This application is based on and claims priority from Korean Patent Application No. 10-2005-67283, filed on Jul. 25, 2005, the disclosure of which is incorporated herein in its entirety by reference.

BACKGROUND OF THE INVENTION

1. Field of the Invention

The present invention relates to the structure of an upper frame for supporting a cabin of construction machinery, and more particularly to a cabin supporting structure provided under a cabin in the form of a fixture, structure, cast member or sheet, whereby when a vertical load or rearward load is applied to the cabin, for example, due to a rollover accident of the construction machinery, and thus the cabin structure is plastically deformed, the cabin supporting structure disperses the vertical load or rearward load applied to the cabin structure.

2. Description of the Prior Art

FIG. 1 is a side view illustrating the construction of a conventional excavator.

Referring to FIG. 1, the conventional excavator includes a lower driving structure 2 having a traveling apparatus, and an upper swing structure 6 having an operation device 4, such as an arm or a bucket, and being swiveled around the lower driving structure 2 through a swing motor and a reduction device.

FIG. 2 is a perspective view illustrating the construction of an upper frame of a conventional excavator.

Referring to FIG. 2, an upper frame 18 is installed under the lower end of the upper swing structure 6 in a rectangular shape. The upper frame 18 includes a center frame 10 fitted with the operation device, a right frame 12 installed on the right side of the center frame 10 and fitted with an engine, a cooling device, diverse units associated with travel and operation of the excavator, and a left frame 16 installed on the left side of the center frame 10 and fitted with a cabin 14.

The center frame 10 has a bottom plate 20 fitted with a swing ring gear, and a lateral plate 22 installed perpendicular to the bottom plate 20 and coupled to the operation device. The left and right frames 16 and 12 have a longitudinally extended side channel 24 and a plurality of side frames 26 laterally extended to connect the center frame 10 to the side channel 24, respectively.

A plurality of vibration absorption devices (not shown) are installed on the side frame 26 of the left frame 16 corresponding to the lower portion of the cabin 10, thereby absorbing vibrations from the engine, the cooling device, and the travel and operation of the excavator, thus preventing the vibration from being transferred to the cabin 14.

FIG. 3 is a perspective view illustrating the construction of a conventional upper frame on which the cabin 14 is mounted.

Referring to FIG. 3, the cabin 14 includes a base plate (not shown) installed on the bottom surface thereof, a vertically extended front pillar 30, a vertically extended center pillar 32, and a vertically extended rear pillar 34 that are assembled on the front, middle, and rear portions of the base plate by fastening means, respectively. A door and a window are installed among the pillars 30, 32, and 34 by welding or bolting.

In order to protect an operator in the cabin 14 against the vertical load or rearward load and to minimize the plastic deformation of the cabin 14 when a rollover accident occurs during an excavation work on the spot, a reinforcing member may be provided in the pillars 30, 32, and 34.

Therefore, although the shock is applied to the cabin from the exterior, the load is preferentially dispersed by the pillars or the reinforcing member to protect the operator.

However, referring to FIG. 4 which is a perspective view illustrating the state in which the vertical load and the rearward load are applied to the cabin of FIG. 3, there is a problem that when the cabin 14 is plastically deformed by the vertical load or rearward load, the upper frame 18 cannot effectively support the vertical strength of the pillars 30, 32, and 34 or the reinforcing member, or cannot disperse the excessive vertical load or rearward load.

In the case in which the excessive load or the rearward load is applied to the conventional cabin structure, the load is dispersed by the pillar or reinforcing member of the cabin structure, but the dispersed load is not again dispersed by the upper frame.

SUMMARY OF THE INVENTION

Accordingly, the present invention has been made to solve the above-mentioned problems occurring in the prior art, and an object of the present invention is to provide a structure of an upper frame for supporting a cabin of construction machinery, whereby a cabin structure is effectively supported on the upper frame although the cabin structure is plastically deformed by a vertical load or rearward load.

In order to accomplish this object, there is provided a structure of an upper frame for supporting a cabin of construction machinery, including a center frame having a lower plate fitted with a swing ring gear and a lateral plate vertically mounted on the lower plate and fitted with operation devices such as a boom, an arm, or a bucket; there is also a left frame mounted on the left side of the center frame, having a side channel extended in a longitudinal direction of the center frame and a plurality of side frames for connecting the center frame with the side channel, according to the present invention, which includes a cabin supporting structure composed of a supporting structure, mounted on the lower plate or lateral plate of the center frame, for supporting a vertical load and a rearward load applied to the cabin.

The cab supporting structure may include a transverse member disposed under the cabin, with the member being spaced apart from a base plate of the cabin at a specified interval, for supporting the cabin upwardly when a load is applied to the cabin in a downward or forward direction; there is also a vertical member fixed to the bottom plate or side plate of the center frame for supporting the transverse member.

The transverse member is a circular member made in a curved shape.

The transverse member is a polygonal member made in a straight shape.

The transverse member is a member mixed with a curved line and a straight line.

The vertical member is at least one circular member vertically extended and made in a curved section.

The vertical member is at least one polygonal member vertically extended and made in a straight section.

The vertical member is at least one member vertically extended and made in a section mixed with a curved shape and a straight shape.

One side of the vertical member is welded to the lateral plate of the center frame, and the lower side of the vertical member is welded to the lower plate of the center frame.

One side of the vertical member is fastened to the lateral plate of the center frame by a bolt, and the lower side of the vertical member is fastened to the lower plate of the center frame by a bolt.

A lower side of the vertical member is welded to the lower plate of the center frame.

One side of the vertical member and one side of the vertical member are welded to the lateral plate of the center frame, and the lower side of each vertical member is welded to the lower plate of the center frame at a specified interval.

One side of the vertical member and one side of the vertical member are welded to the lateral plate of the center frame, and the lower side of each vertical member is spaced apart from the lower plate of the center frame at a specified interval.

According to another aspect of the present invention, there is provided a structure of an upper frame for supporting a cabin of construction machinery, including a center frame having a lower plate fitted with a swing ring gear and a lateral plate vertically mounted on the lower plate and fitted with operation devices such as a boom, an arm, or a bucket; there is also a left frame mounted on the left side of the center frame, having a side channel extended in a longitudinal direction of the center frame and a plurality of side frames for connecting the center frame with the side channel, which includes a cabin supporting structure composed of a single support member, mounted on the lower plate or lateral plate of the center frame, for supporting a vertical load and a rearward load applied to the cabin.

The single support member of the cabin supporting structure is formed by casting, and is disposed on the lower plate or lateral plate under the cabin, with the single support member being spaced apart from a base plate of the cabin at a specified interval, so that the single support member supports the cabin upwardly when a load is applied to the cabin in a downward or forward direction.

The single support member of the cabin supporting structure is formed by forging, and is disposed on the lower plate or lateral plate under the cabin, with the single support member being spaced apart from a base plate of the cabin at a specified interval, so that the single support member supports the cabin upwardly when a load is applied to the cabin in a downward or forward direction.

The single support member of the cabin supporting structure is formed by bending a sheet, and has a vertical member fixed to the lateral plate by welding and a lateral member fixed to the lower plate by welding, so that the single support member supports the cabin upwardly or rearward when a load is applied to the cabin in a downward or forward direction.

According to still another aspect of the present invention, there is provided a structure of an upper frame for supporting a cabin of construction machinery, including a center frame having a lower plate fitted with a swing ring gear and a lateral plate vertically mounted on the lower plate and fitted with operation devices such as a boom, an arm, or a bucket; there is also a left frame mounted on the left side of the center frame, having a side channel extended in a longitudinal direction of the center frame and a plurality of side frames for connecting the center frame with the side channel, which includes a cabin supporting structure, mounted on one side of the side channel, for additionally supporting an upper surface of the side channel when a vertical load and a rearward load are applied to the cabin.

The cabin supporting structure is a sheet bent at a right angle, and has a vertical portion fixed to an inner vertical surface of the side channel and a horizontal portion fixed to a bottom of a horizontal surface of the side channel to reinforce strength of the horizontal surface.

The cabin supporting structure is a vertical sheet, has one side fixed to an inner vertical surface of the side channel, and has an upper portion fixed to a bottom of a horizontal surface of the side channel to reinforce strength of the horizontal surface.

According to still another aspect of the present invention, there is provided a structure of an upper frame for supporting a cabin of construction machinery, including a center frame having a lower plate fitted with a swing ring gear and a lateral plate vertically mounted on the lower plate and fitted with operation devices such as a boom, an arm, or a bucket; there is also a left frame mounted on the left side of the center frame, having a side channel extended in a longitudinal direction of the center frame and a plurality of side frames for connecting the center frame with the side channel, which includes a first cabin supporting structure, mounted on the lower plate of the center frame, for supporting a vertical load and a rearward load applied to the cabin, and a second cabin supporting structure, mounted on one side of the side channel, for supporting an upper surface of the side channel when a vertical load and a rearward load are applied to the cabin.

With the construction, the structure of the upper frame for supporting the cabin of construction machinery according to the present invention can minimize plastic deformation of the cabin structure when a rollover accident occurs.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

The construction of an upper frame for supporting a cabin of construction machinery according to the present invention will now be described in detail with reference to preferred embodiments.

Figure 1:
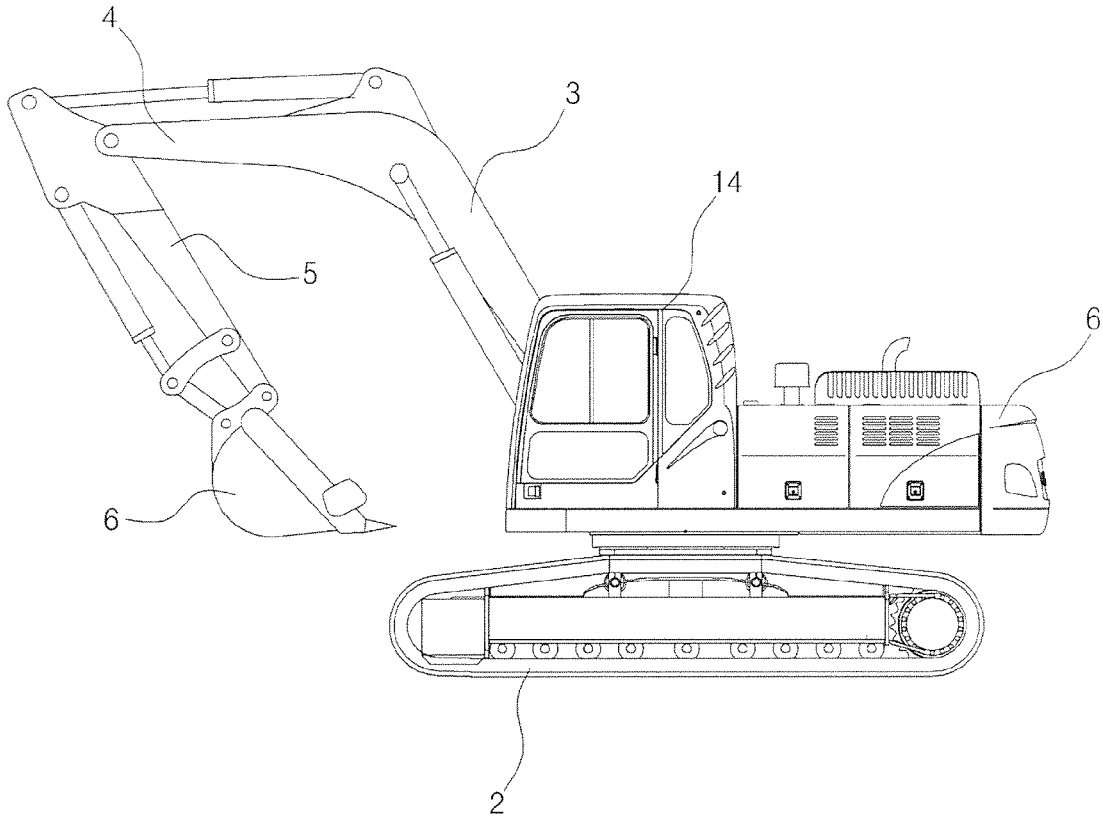
FIG. 1 is a side view illustrating the construction of a conventional excavator.
Figure 2:
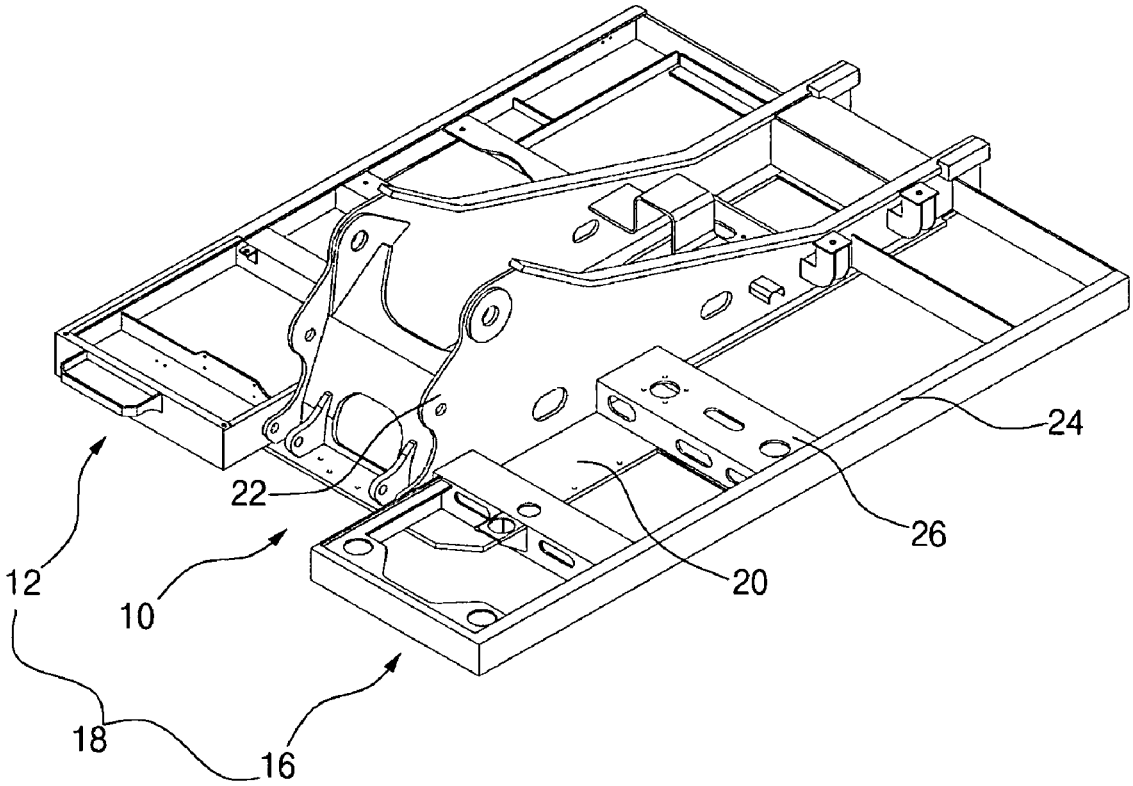
Fig. 2 Prior Art
FIG. 2 is a perspective view illustrating the construction of an upper frame of a conventional excavator.
Figure 3:
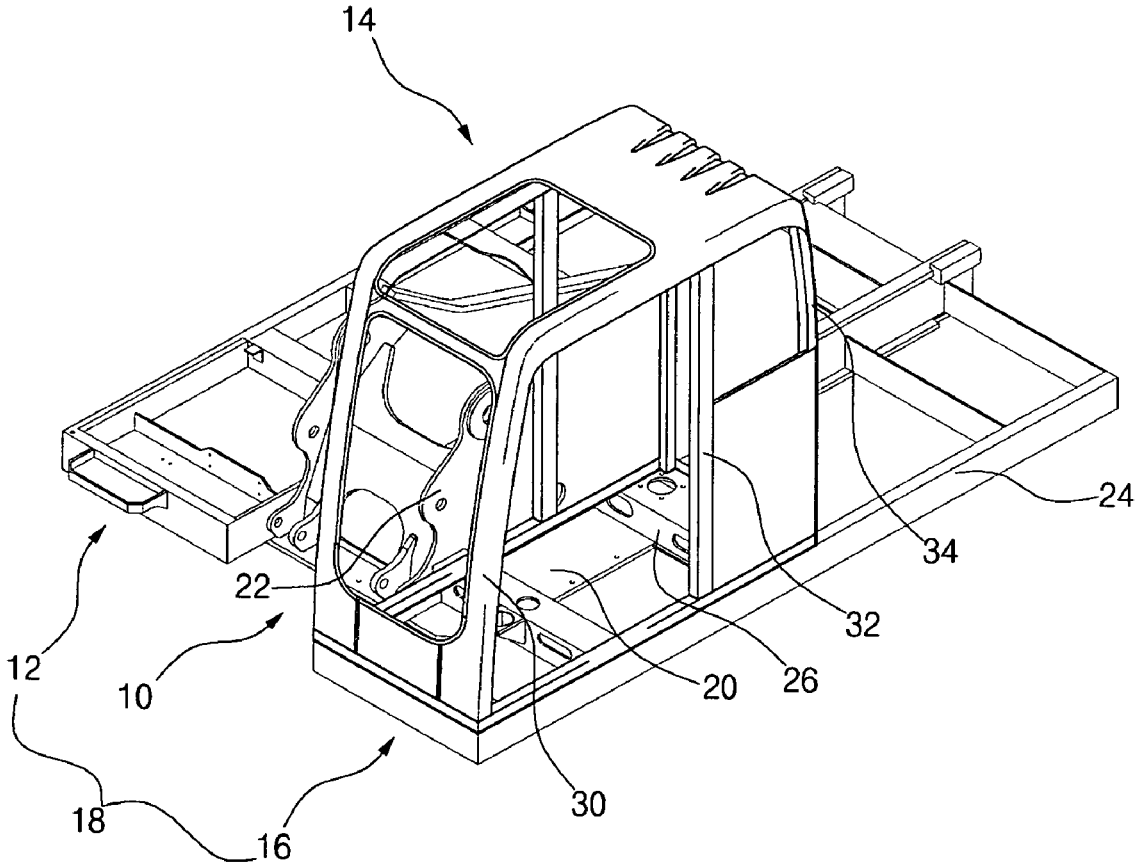
Fig. 3 Prior Art
FIG. 3 is a perspective view illustrating the construction of a conventional upper frame on which a cabin is mounted.
Figure 4:
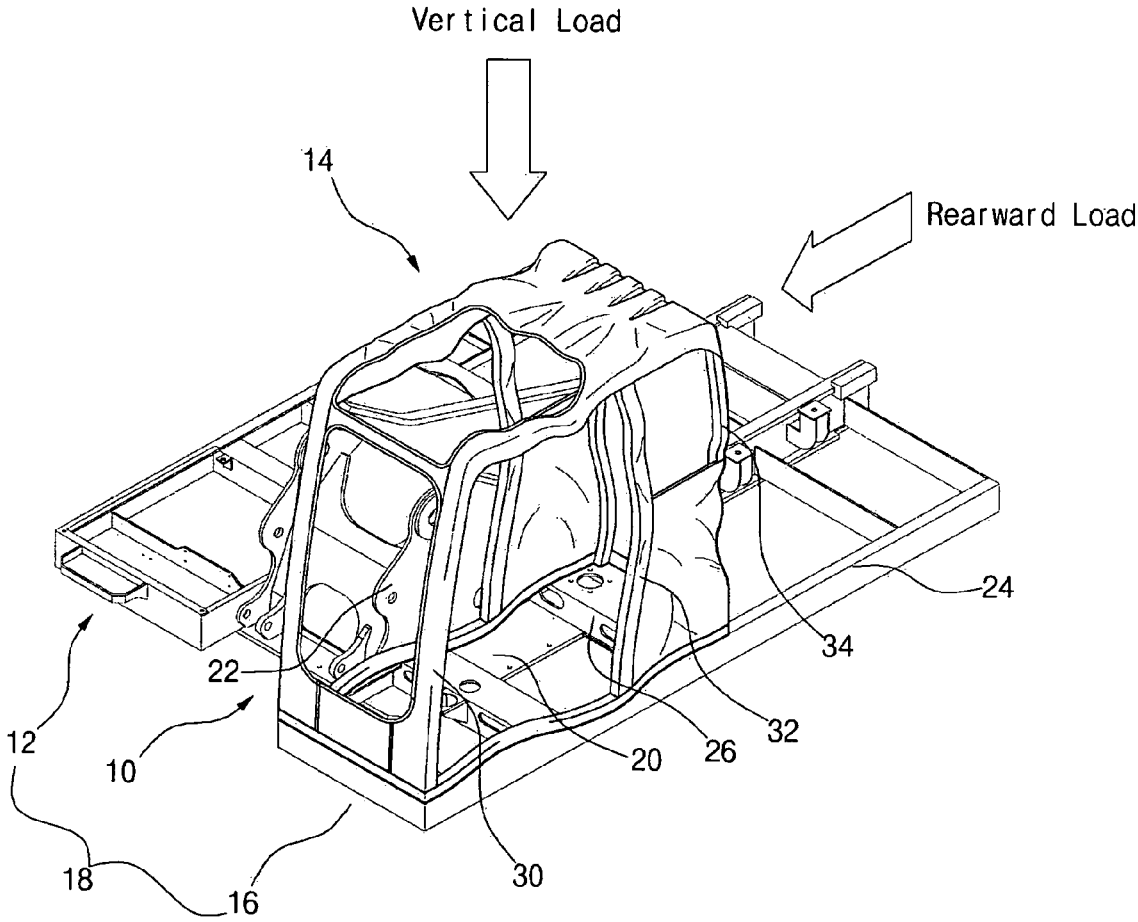
Fig. 4 Prior Art
FIG. 4 is a perspective view illustrating the state in which a vertical load and a rearward load are applied to the cabin of FIG. 3.
Figure 5:
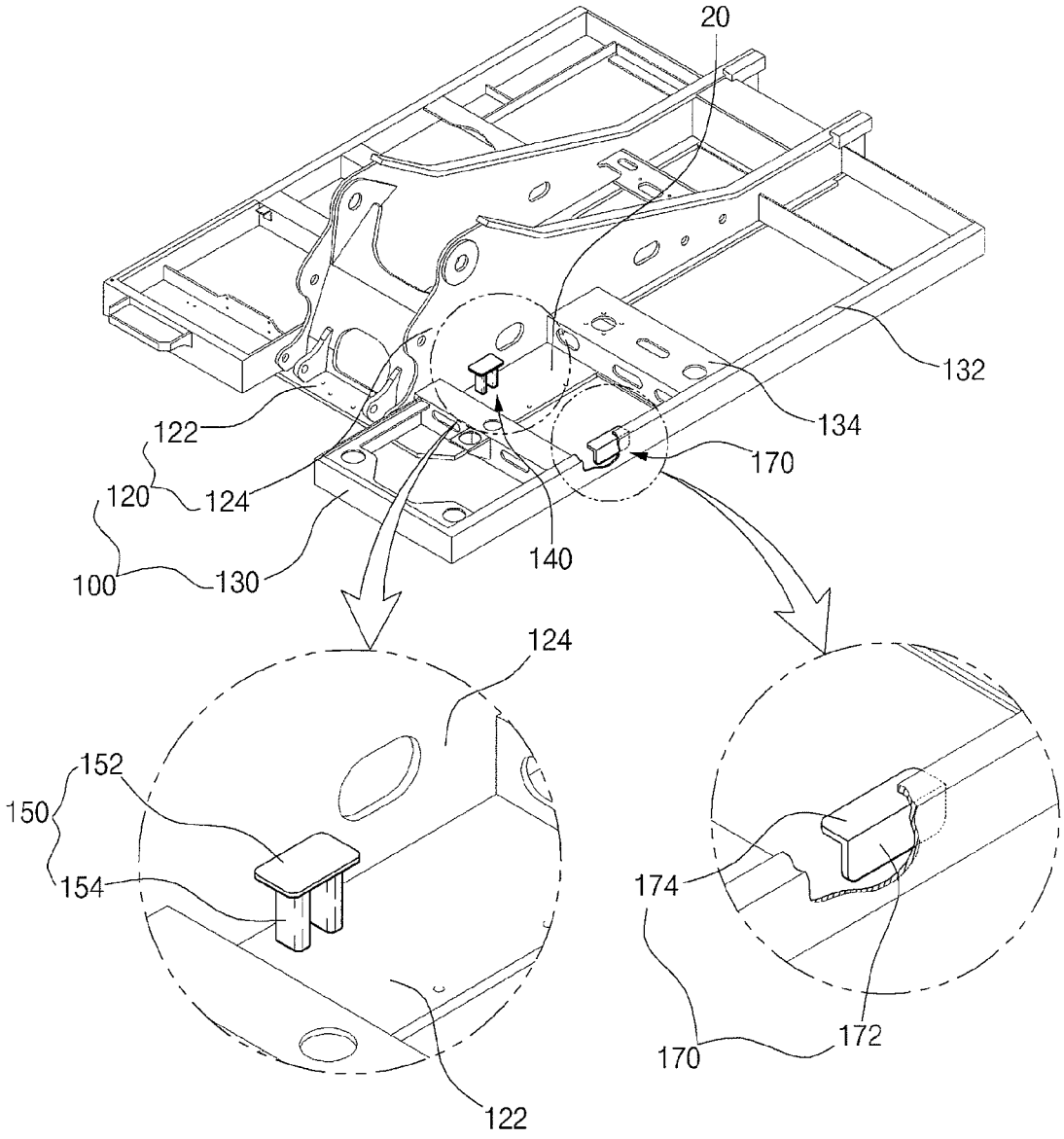
FIG. 5 is a perspective view illustrating the structure of an upper frame supporting a cabin according to a preferred embodiment of the present invention.

In FIG. 5, a structure of an upper frame for supporting a cabin according to a preferred embodiment of the present invention is illustrated.

Referring to FIG. 5, construction machinery, such as an excavator, includes a lower driving structure (not shown) having wheels or a caterpillar, and a rotatable upper frame 100 mounted on the lower driving structure. The upper frame 100 is provided with a cabin 110, in which an operator sits. A plurality of vibration absorption devices (not shown) are installed under the cabin 110 to prevent the vibration generated from the engine the cooling device, which are mounted on the upper frame 100, and the travel and operation of the excavator from being transferred to the cabin 110. However, the vibration absorption devices become ineffective when an excessive vertical load or rearward load, which is beyond the elastic limit of the construction machinery, is applied to the construction machinery due to the rollover of the construction machinery and so on.

Accordingly, the upper frame structure according to the present invention further includes a cabin supporting structure 140 for effectively dispersing the load to protect the operator when the structure of the cabin 110 is plastically deformed by the excessive load which may destruct the function of the vibration absorption devices, as shown in FIG. 5.

The upper frame 100 includes a center frame 120 fitted with operation devices, such as a boom or an arm, and a left frame 130 mounted on the left side of the center frame 120. The center frame 120 has a lower plate 122 fitted with a swing ring gear, and a lateral plate 124 vertically mounted on the lower plate 122 and connected to the operation device. The left frame 130 has a side channel 132 extended in a longitudinal direction, and a plurality of side frames 134 extended in a horizontal direction for connecting the center frame 120 with the side channel 132.

The cabin supporting structure has a first cabin supporting structure 140 mounted on the lower plate 122 or the lateral plate 124 of the center frame 120, and a second cabin supporting structure 170 mounted on the side channel 132 of the left frame 130.

The first cabin supporting structure 140 of the present invention is mounted on the lower plate 122 and the lateral plate 124 of the center frame 120, and it may be composed of a support structure or single support member.

In the case in which the first cabin supporting structure 140 is composed of a support structure 150, as shown in FIG. 5, the support structure 150 is disposed under the cabin 110, with it being spaced apart from the lower portion of the cabin at a specified interval. The support structure 150 has a transverse member 152 for supporting the cabin 110 when the load is vertically applied to the cabin 110, and a vertical member 154 fixed to the lower plate 122 for supporting the transverse member 152. The transverse member 152 may be formed of a flat plate which is flush with a horizontal surface of the side frame 134 or has a height similar to that of the side frame 134. Also, the transverse member may have a circular shape, a polygonal shape, or any shape combined with the circular shape and the polygonal shape.

The vertical member 154 may be a closed column extended in a vertical direction and formed in a circular shape, a polygonal shape, or any shape combined with the circular shape and the polygonal shape. Alternatively, the vertical member 154 is an open column.

It is preferable that the structure 150 is attached to the center frame 120 by welding, but the present invention is not limited thereto. For example, the support structure 150 may be fastened to the center frame by bolts. Since the center frame may be thermally deformed by the welding, it is preferable that the support structure 150 is welded to the lower plate 122 or lateral plate 124 of the center frame 120, before the lower plate 122 and the lateral plate 124 are machined.

The load applied to the structure of the cabin 110 is effectively dispersed by mounting the first cabin supporting structure 140 at a position corresponding to the lower portion of the pillar or reinforcing member of the cabin 110.

Figure 6:
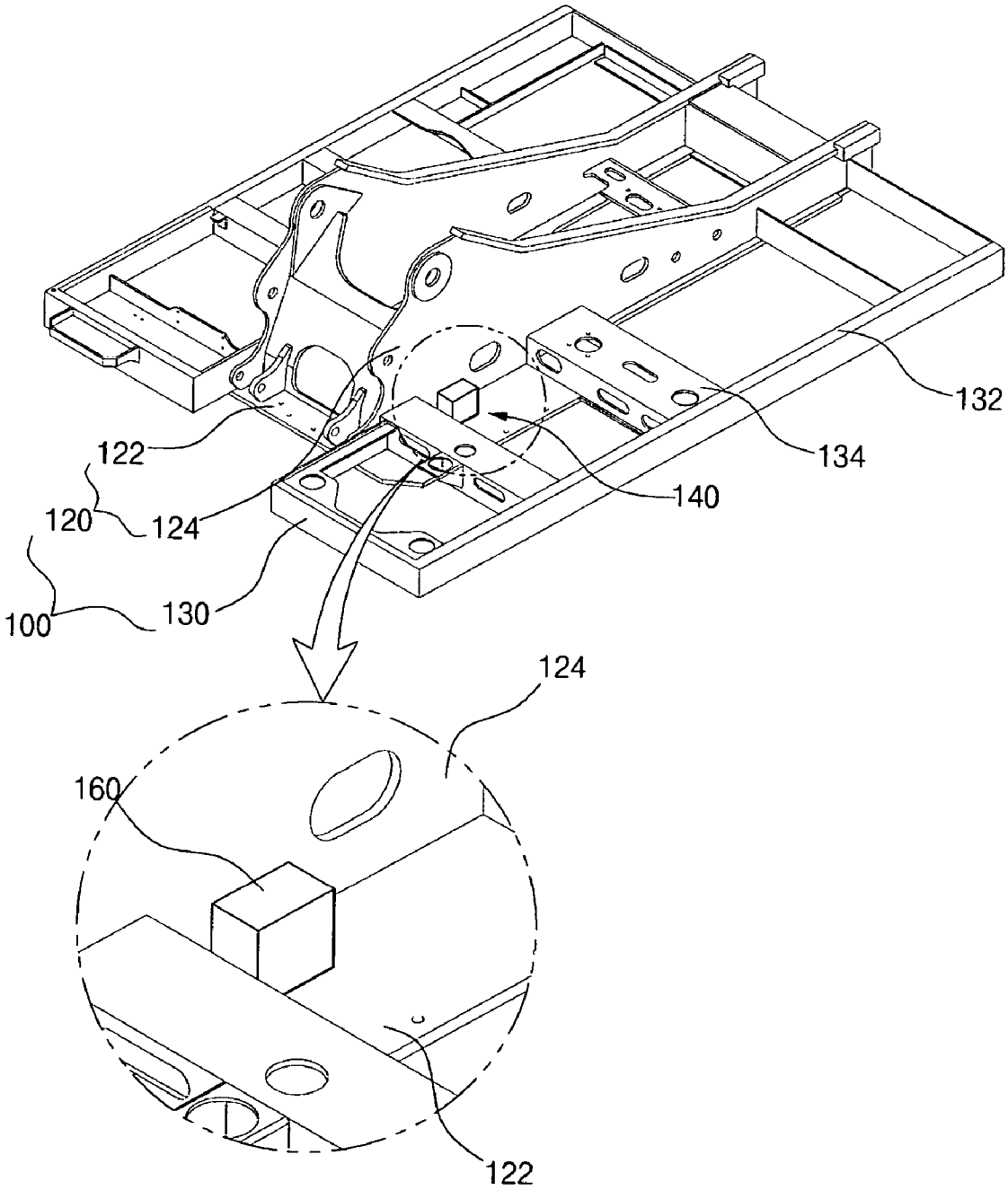
FIG. 6 is a perspective view illustrating the structure of an upper frame supporting a cabin according to another embodiment of the present invention.
Figure 7:
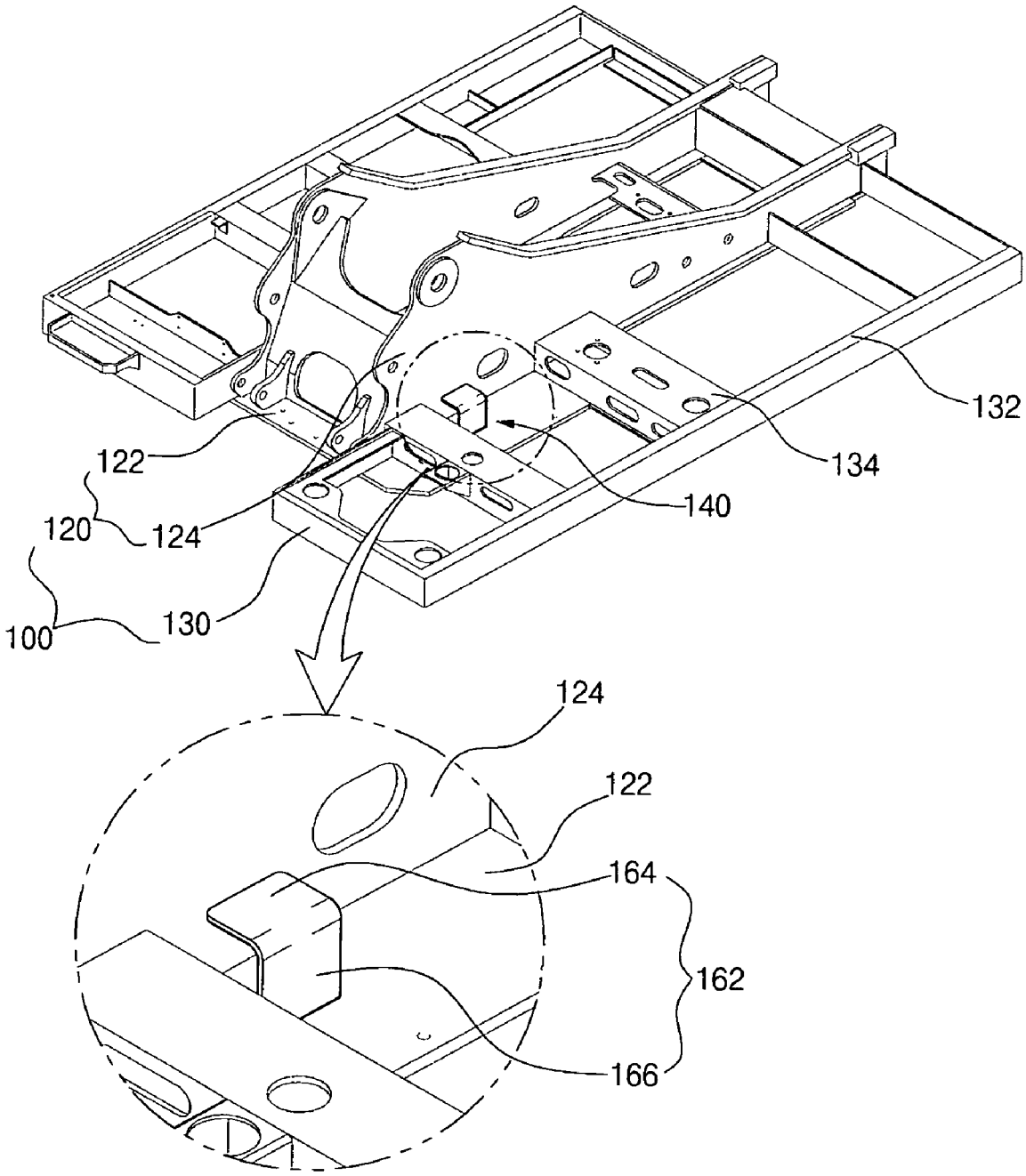
FIG. 7 is a perspective view illustrating the structure of an upper frame supporting a cabin according to another embodiment of the present invention.

FIGS. 6 and 7 are perspective views illustrating the structure of the upper frame supporting the cabin according to another embodiment of the present invention.

In the case in which the first cabin supporting structure 140 is composed of a single support member 160 or 162, the member has the same shape as that of the support structure as shown in FIG. 5 or has a shape similar to that. However, depending on the manufacturing method, the single support member may be a cast member 160 made by casting shown in FIG. 6, or a sheet metal member 162 made by metal sheet forming shown in FIG. 7.

Referring to FIG. 7, the attachment of the single support member 162 to the upper frame 100 is achieved by welding the transverse member 164 to the lateral plate 124 of the center frame 120, welding the vertical member 166 to the lower plate 122 of the center frame 120, or welding the vertical member 166 and the transverse member 164 to the lower plate 122 and lateral plate 124, respectively. In addition to the welding, any method of effectively supporting the vertical load of the cabin may be employed.

Figure 8:
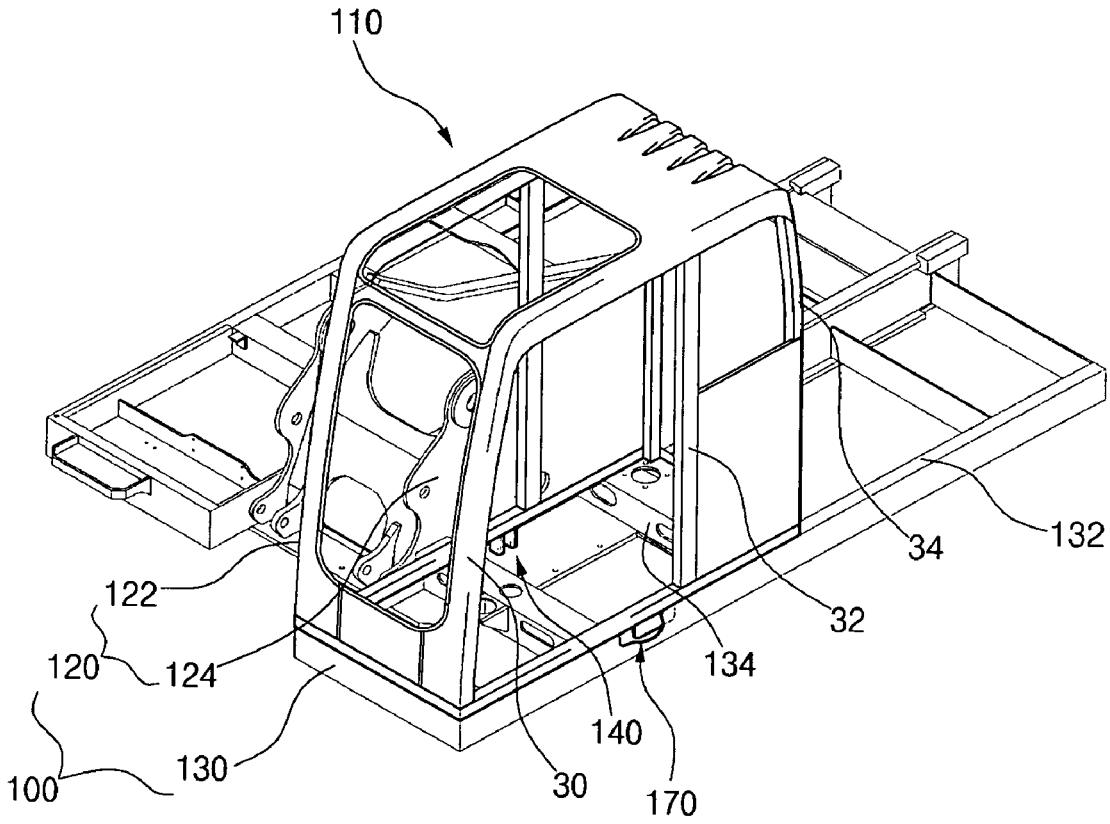
FIG. 8 is a perspective view illustrating the construction of an upper frame on which a cabin is mounted, according to an embodiment of the present invention.

FIG. 8 is a perspective view illustrating the construction of the upper frame on which the cabin is mounted, according to an embodiment of the present invention.

Referring to FIG. 8, the second cabin supporting structure is adapted to additionally support the upper surface of the side channel 132.

As shown in FIG. 5, the second cabin supporting structure 170 is an angled sheet that has a vertical portion 172 fixed to an inner vertical surface of the side channel and a horizontal portion 174 fixed to the bottom of the horizontal surface of the side channel to reinforce the strength of the horizontal surface.

In this case, the second cabin supporting structure 170 can also be attached to the side channel 132 by welding or bolting.

The second cabin supporting structure 170 is not limited to the shape of the sheet, as well as the first cabin supporting structure 140, and a cast member may be employed.

Figure 9:
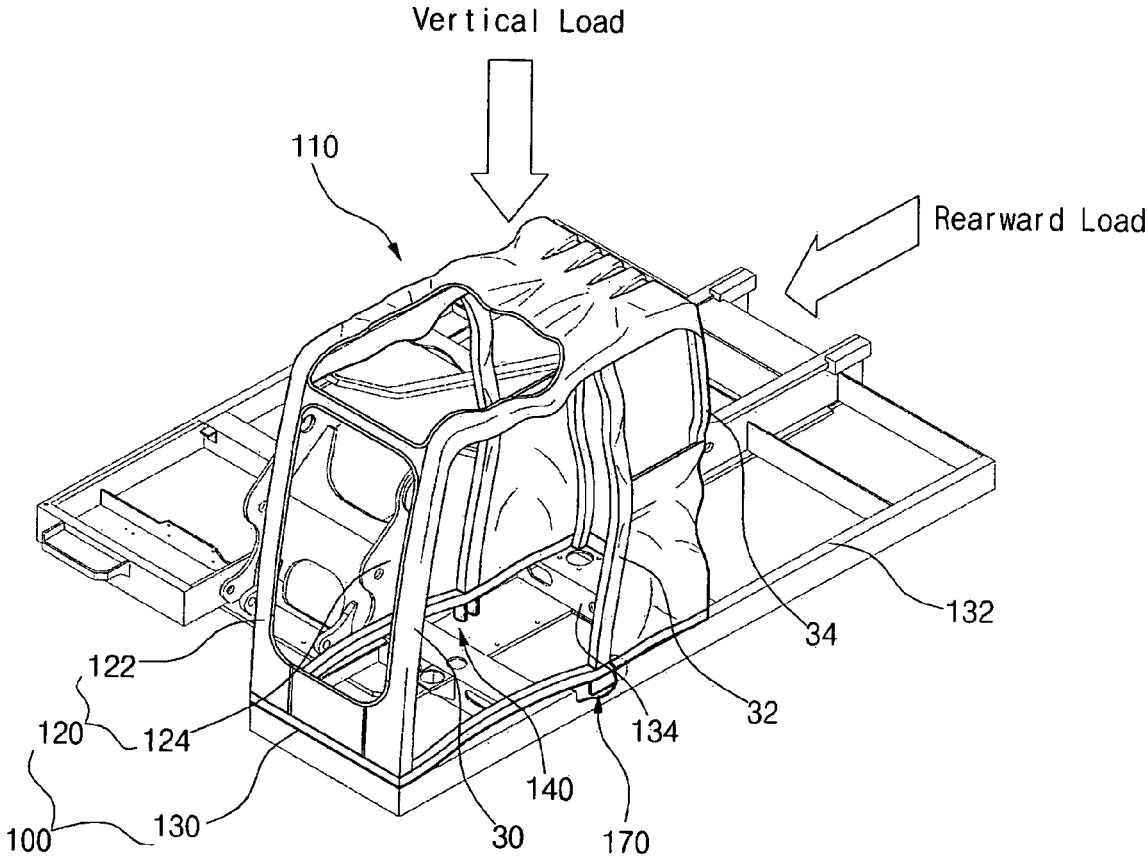
FIG. 9 a perspective view illustrating the state in which a vertical load and a rearward load are applied to the cabin of FIG. 8.

According to the present invention disclosing the construction of the upper frame for supporting the cabin of the construction machinery, it would be understood from the above description that the vertical load or rearward load generated in the event of the rollover accident is primarily dispersed by the reinforcing member of the cabin structure, such as pillar or reinforcing member, and the dispersed load is again dispersed by providing the upper frame, on which the cabin is mounted, with the additional cabin supporting structure, as shown in FIG. 8, so that the plastic deformation of the cabin structure due to the excessive load can be minimized, as shown in FIG. 9.

According to the present invention, in the event of a rollover accident, an excessive vertical load or rearward load applied to a cabin structure is primarily dispersed by a reinforcing member of the cabin structure, and the dispersed load is supported by the separate cabin supporting structure, so that the plastic deformation of the cabin structure can be minimized.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A structure of an upper frame 100 for supporting a cabin of construction machinery, including a center frame 120 having a lower plate 122 and a lateral plate 124 vertically mounted on the lower plate 122 and fitted with operation devices comprising at least one of a boom 3, an arm 5, and a bucket 6, a left frame 130 mounted on the left side of the center frame 120 comprising a side channel 132 extended in a longitudinal direction of the center frame 120 and a plurality of side frames 134 for connecting the center frame 120 with the side channel 132, the upper frame structure 100 further comprising:

a first cabin supporting structure 150 installed between the side frames 134, for supporting a vertical load and a rearward load applied to the cabin; and a second cabin supporting structure 170 extending in the longitudinal direction of the center frame mounted on one side of the side channel 132, for supporting an upper surface of the side channel 132;

wherein the first cabin supporting structure 150 comprises a transverse member 152 formed of a flat plate distant from the side frames 134 and attached with the lateral plate 124 which has a height similar to a horizontal surface of the side frame 134, and a vertical member 154 is fixed to the lower plate 122 of the center frame 120 for supporting the transverse member 152, and wherein the second cabin supporting structure 170 comprises an angled vertical plate 172 fixed to an inner vertical surface of the side channel 132 and a horizontal plate 174 fixed to the bottom of the horizontal surface of the side channel 132 to reinforce the strength of the horizontal surface, thereby supporting a vertical load and a rearward load applied to the cabin.

2. The structure of the upper frame as claimed in claim 1, wherein the transverse member is of a circular shape.

3. The structure of the upper frame as claimed in claim 1, wherein the transverse member is of a polygonal shape.

4. The structure of the upper frame as claimed in claim 1, wherein the vertical member is of circular shape vertically extended from the bottom plate.

5. The structure of the upper frame as claimed in claim 1, wherein the vertical member is at least one polygonal member vertically extended and made in a straight section.

6. The structure of the upper frame as claimed in claim 1, wherein one side of the vertical member is welded to the lateral plate of the center frame, and a lower side of the vertical member is welded to the lower plate of the center frame.

7. The structure of the upper frame as claimed in claim 1, wherein one side of the vertical member is fastened to the lateral plate of the center frame by a bolt, and a lower side of the vertical member is fastened to the lower plate of the center frame by a bolt.

8. The structure of the upper frame as claimed in claim 1, wherein only a lower side of the vertical member is welded to the lower plate of the center frame.

9. The structure of the upper frame as claimed in claim 1, wherein one side of the vertical member and one side of the transverse member are welded to the lateral plate of the center frame, and a lower side of the vertical member is welded to the lower plate of the center frame.

10. The structure of the upper frame as claimed in claim 1, wherein the first cabin supporting structure is formed by casting, and is disposed under the cabin.

11. The structure of the upper frame as claimed in claim 1, wherein the first cabin supporting structure is formed by forging, and is disposed under the cabin.

12. The structure of the upper frame as claimed in claim 1, wherein the first cabin supporting structure is formed by bending a sheet, the transverse member is fixed to the lateral plate by welding and the vertical member is fixed to the lower plate by welding.

* * * * *